US008602525B2

(12) United States Patent
Ozawa

(10) Patent No.: US 8,602,525 B2
(45) Date of Patent: Dec. 10, 2013

(54) LIQUID EJECTING METHOD AND LIQUID EJECTING APPARATUS

(71) Applicant: Seiko Epson Corporation, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/827,406

(22) Filed: Mar. 14, 2013

(65) Prior Publication Data

US 2013/0201253 A1 Aug. 8, 2013

Related U.S. Application Data

(62) Division of application No. 13/045,888, filed on Mar. 11, 2011, now Pat. No. 8,419,177.

(30) Foreign Application Priority Data

Mar. 18, 2010 (JP) ..... 2010-062165

(51) Int. Cl.
*B41J 11/00* (2006.01)

(52) U.S. Cl.
USPC ..... 347/41; 347/100

(58) Field of Classification Search
USPC ..... 347/40, 41, 43, 95, 98, 100
See application file for complete search history.

(56) References Cited

U.S. PATENT DOCUMENTS

| | | | | |
|---|---|---|---|---|
| 6,474,778 | B1 * | 11/2002 | Koitabashi et al. | 347/43 |
| 6,517,191 | B1 * | 2/2003 | Koitabashi | 347/43 |
| 6,863,392 | B2 | 3/2005 | Shimomura et al. | |
| 7,185,964 | B2 * | 3/2007 | Kanda et al. | 347/15 |
| 7,261,405 | B2 | 8/2007 | Ohya et al. | |
| 8,118,401 | B2 | 2/2012 | Yoshida | |

FOREIGN PATENT DOCUMENTS

JP 2009-126071 6/2009

* cited by examiner

*Primary Examiner* — Lamson Nguyen
(74) *Attorney, Agent, or Firm* — Workman Nydegger

(57) ABSTRACT

After a gloss-based liquid is ejected from a liquid ejection head, which ejects liquid from nozzles of a nozzle row, to a predetermined position on a landing target to form a glossy layer, a white-based liquid is ejected onto the glossy layer to form a white layer, the ejection amount of the gloss-based liquid being greater than the ejection amount of the white-based liquid.

5 Claims, 8 Drawing Sheets

LIQUID EJECTING METHOD AND LIQUID EJECTING APPARATUS

CROSS REFERENCES TO RELATED APPLICATIONS

This application is a Division of application Ser. No. 13/045,888, filed Mar. 11, 2011, and is expressly incorporated herein by reference. The entire disclosure of Japanese Patent Application No. 2010-062165, filed Mar. 18, 2010, is expressly incorporated herein by reference.

BACKGROUND OF THE INVENTION

1. Technical Field

The present invention relates to a liquid ejecting method for use in a liquid ejecting apparatus including, for example, an ink jet type recording head, and a liquid ejecting apparatus.

2. Related Art

In liquid ejecting apparatuses currently known in the art, printers are configured to perform various applications using a special color of ink in addition to black (K), cyan (C), magenta (M), and yellow (Y) that are colors becoming the basis of the formation of a letter or an image. For example, a printer disclosed in Japanese Patent Document JP-A-2009-126071 is configured so that the recording can be performed using a white ink including a white pigment or a silver ink including a metal pigment. By performing the recording of the image or the like using the white ink or the silver ink, a wider range of color expression is possible.

Unfortunately, however, a recording method currently used with such inks is less efficient than other printers. As such there is a need for an apparatus configuration thereof that is more effective when using the additional ink, such as white ink or silver ink.

BRIEF SUMMARY OF THE INVENTION

A liquid ejecting method according to an embodiment of the present invention includes ejecting a gloss-based liquid from a liquid ejecting head for ejecting liquid from nozzles of a nozzle row to a predetermined position on a landing target to form a glossy layer, and ejecting a white-based liquid on the glossy layer to form a white layer, wherein, in forming the glossy layer, the liquid is discharged so that an ejection amount of the gloss-based liquid becomes greater than an ejection amount of the white-based liquid ejected when forming the white layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for carrying out the invention will be described with reference to the drawings. In addition, in the embodiment described later, various limitations as desirable specific examples of the invention exist, but the scope of the invention is not limited to these aspects unless there is a description to the effect that the invention is limited in the following description. Note that, in the present embodiment, a configuration in which an image recording apparatus that is a form of a liquid ejecting apparatus, specifically, an ink jet type printer (hereinafter, referred to as a printer) with an ink jet type recording head (hereinafter, simply referred to as a recording head) as a liquid ejecting head mounted thereon will be described by way of example.

In addition, in the following description, the term "white-based" means a color that is visually recognized as white, and means that, for example, white with a slight hint of color known as off-white or ivory white is also included without being limited to white of an achromatic color.

Moreover, in the following description, the term "gloss-based liquid" means a liquid that includes a metallic powder, a pearl powder or the like as a pigment and allows visual recognition of the glossy feeling through the reflection of light by the pigment.

Figure 1:
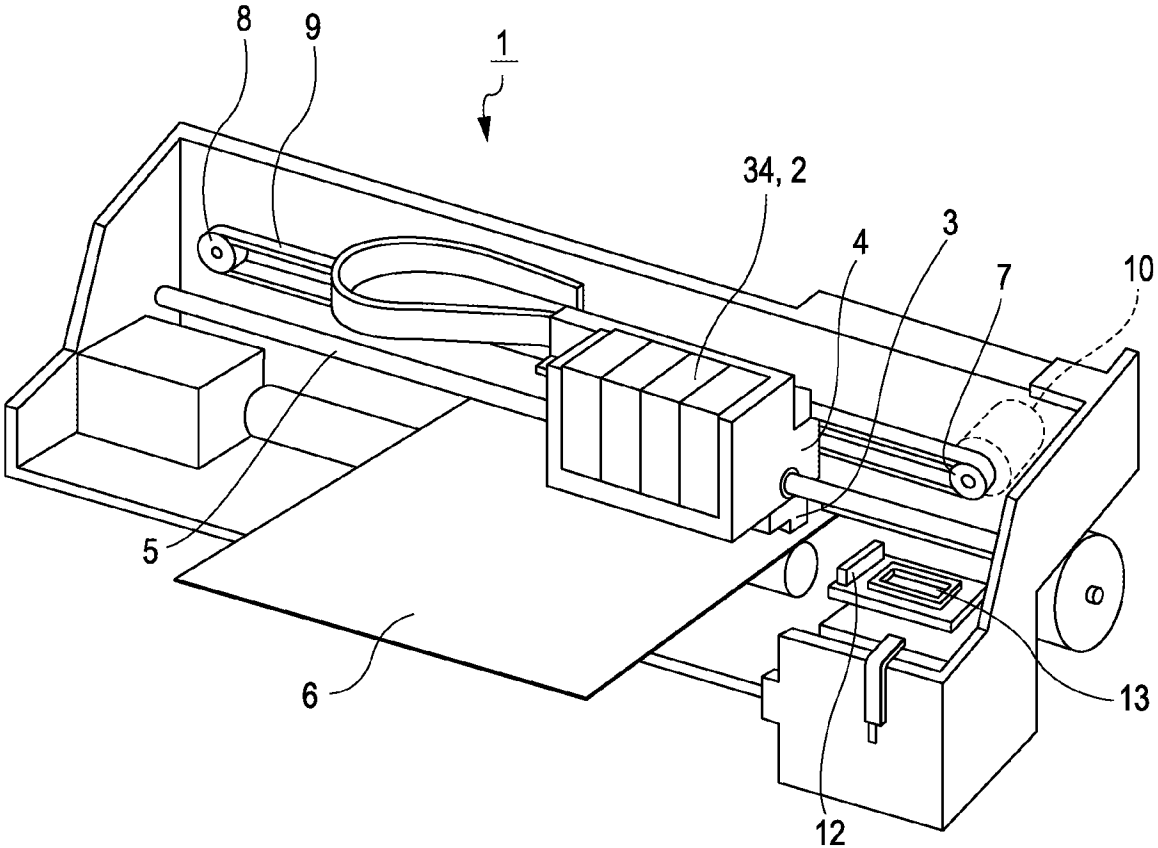
FIG. 1 is a perspective view that illustrates a configuration of a printer according to an aspect of the invention.

Firstly, the overall structure of a printer 1 will be described based on FIG. 1. The exemplified printer 1 has a carriage 4 on which a cartridge mounting portion 2 and a recording head 3 (a kind of liquid ejecting head of the invention) are provided. The carriage 4 is pivotally supported on a guide rod 5 and is mounted movably in a width direction (a main scanning direction) of a recording paper 6. A timing belt 9 spanning between a driving pulley 7 and a free rolling pulley 8 is connected to the carriage 4. In addition, the driving pulley 7 is connected to a rotational axis of a pulse motor 10. Thus, the carriage 4 moves in a width direction of the recording paper 6 (that is a kind of recording medium and a kind of landing object in the invention) by the operation of the pulse motor 10. In a given area within the movement range of the carriage 4, a home position is set, is the home position being situated at the time of standby in which the recording head 3 does not perform the recording operation relative to the recording paper 6. A wiper mechanism 12 for cleaning a surface of a nozzle plate 11 (see FIG. 2) of the recording head 3, and a capping mechanism 13 capable of sealing the nozzle forming surface are disposed in the home position.

Figure 2:
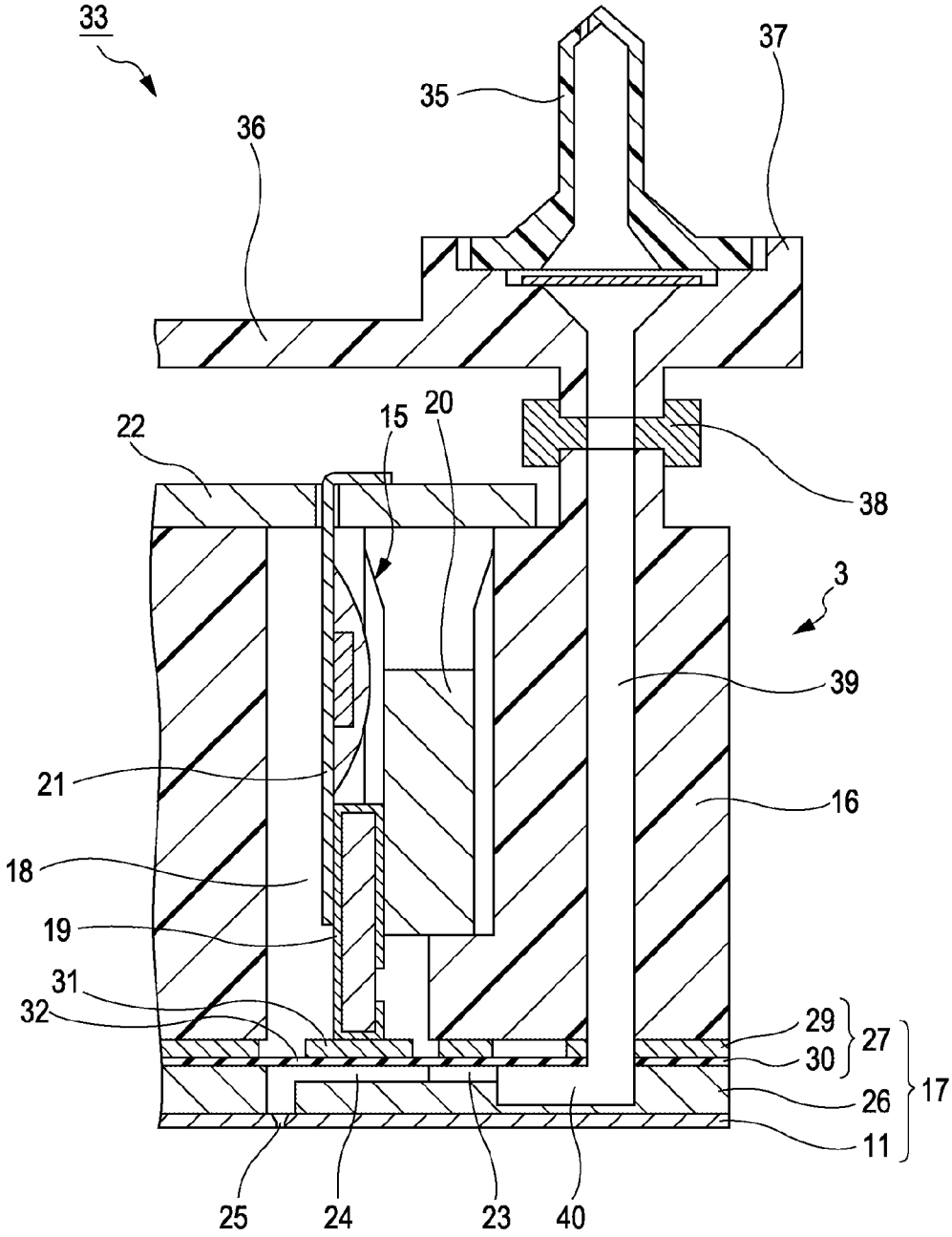
FIG. 2 is a partial enlarged cross-sectional view of a recording head according to an aspect of the invention.

As the recording head, recording heads of various configurations can be used, but, in the present embodiment, the recording head 3 shown in FIG. 2 is mounted on the printer 1. The recording head 3 includes a vibrator unit 15, a case 16 capable of receiving the vibrator unit 15 therein, a flow path unit 17 that is connected to a front surface of the case 16 or the like.

The case 16 is a block-shaped member having a receiving space portion 18 for receiving the vibrator unit 15 therein and is produced, for example, by molding resin (epoxy resin or the like). The vibrator unit 15 includes a plurality of piezoelectric vibrators 19 formed in the shape, such as a comb, a fixing plate 20 to which each piezoelectric vibrator 19 is connected, and a flexible cable 21 for supplying a drive signal or the like to each piezoelectric vibrator 19.

The piezoelectric vibrator 19 is a kind of pressure generating unit. The piezoelectric vibrator 19 of the present embodiment is a laminated type piezoelectric vibrator that is produced, for example, by separating the piezoelectric plate, in which a piezoelectric layer and an electrode layer are alternately laminated over each other, in the shape such as a comb, and is a piezoelectric vibrator of a longitudinal vibration mode capable of stretching in a direction perpendicular to a stacked direction.

The fixing plate 20 is a plate material made of metal that can accept the reaction from the piezoelectric vibrator 19. The flexible cable 21 is a film-shaped wiring member having the flexibility. In addition, a terminal of one end of the flexible cable 21 is soldered to a terminal of the piezoelectric vibrator 19, and a terminal of the other side thereof is soldered to a terminal of a wiring substrate 22.

Upon applying the electric field to the piezoelectric layer constituting the piezoelectric vibrator 19, that is, upon supplying the drive signal via the flexible cable 21, the free end stretches in an element length direction (a direction perpendicular to the stacked direction). For example, when the electric potential of the vibrator is raised by the charging, the piezoelectric vibrator 19 contracts in the element length direction, and when the electric potential of the vibrator is dropped by the discharging, the piezoelectric vibrator 19 stretches in the element length direction.

The flow path unit 17 is a plate-shaped member having a series of individual liquid flow paths that lead from a liquid supply hole 23 via a pressure chamber 24 to a nozzle 25. The flow path unit 17 includes a flow path forming substrate 26 having a space portion, a groove portion or the like becoming the pressure portion 24 or the liquid supply hole 23, an elastic plate 27 that seals the opening of the space portion or the groove portion to partition a part of the pressure chamber 24 or the liquid supply hole 23, and a nozzle plate 11 in which a plurality of nozzles 25 is formed. In addition, the elastic plate 27 is connected to one surface of the flow path forming substrate 26, that is, the surface of the case side, and the nozzle plate 11 is connected to the other surface of the flow path forming substrate 26, that is, the surface of an opposite side of the elastic plate connecting surface. The configuration of the nozzle plate 11 will be described later.

The elastic plate 27 has a double structure in which an elastic body film 30 is stacked over the surface of a support plate 29. In the present embodiment, a stainless plate, which is a kind of metallic plate, is formed as the support plate 29, whereby the elastic plate 27 is produced using a complex plate material in which a resin film made of PPS (polyphenylene sulfide) or PI (polyimide) is laminated on the surface of the support plate 29 as the elastic body film 30. In the elastic plate 27, a diaphragm portion which varies the volume of the pressure chamber is provided. Furthermore, in the elastic plate 27, a compliance portion which seals a part of a common liquid chamber 40 is provided.

The diaphragm portion is produced by partially removing the support plate 29 through an etching machining process or the like. That is, the diaphragm portion includes an island portion 31 to which the front surface of the piezoelectric vibrator 19 is connected, and a thin elastic portion 32 surrounding the island portion 31. The compliance portion is a portion for absorbing the pressure fluctuation of the liquid stored in the common liquid chamber 40. The damper portion is also produced by removing the support plate 29 of the area facing the opening surface of the storing space portion through the etching machining or the like to leave only the elastic body film 30.

Furthermore, since the front surface of the piezoelectric vibrator 19 is connected to the island portion 31, the volume of the pressure chamber can be varied by stretching the free end. For example, when the piezoelectric vibrator 19 is charged to contract the free end in the element length direction, the island portion 31 is extended. As a result, the island portion 31 is moved, whereby the volume of the pressure chamber can be increased as compared to the discharging state of the piezoelectric vibrator 19. Moreover, when the piezoelectric vibrator 19 of the charged state is discharged to stretch the free end in the element length direction, the island portion 31 is pushed to the pressure chamber 24 side. As a result, the volume of the pressure chamber can be reduced as compared to the charged state of the piezoelectric vibrator 19.

A supply needle unit 33 is provided in the cartridge mounting portion 2. The supply needle unit 33 is a portion connected to a liquid cartridge 34 (a kind of liquid supply source) in which liquid is stored, and the liquid stored in the liquid cartridge 34 is supplied into the recording head 3 via the supply needle unit 33. In addition, as the liquid supply source, a liquid storage pack (a storage body in which liquid is stored) may be used without being limited to the liquid cartridge 34. Furthermore, it is also possible to adopt a configuration in which a liquid supply source such as the liquid cartridge 34 is disposed at the main body side of the printer 1 and ink is supplied from the liquid supply source through the ink supply tube to the recording head 3. Moreover, a configuration, in which the liquid storage tank is disposed outside the printer and the tank is directly or indirectly connected to the flow path of the inner portion of the printer, may be adopted.

The supply needle unit 33 in the present embodiment is roughly constituted by a liquid supply needle 35 and a needle holder 36. The liquid supply needle 35 is a member that is inserted into the inner portion of the liquid cartridge 34, and introduces the liquid, which was stored in the liquid cartridge 34, into the needle. The top of the liquid supply needle 35 is sharpened in a conical shape, and a plurality of liquid introduction holes extending between the inside and outside the needle are formed. The needle holder 36 is a member for attaching the liquid supply needle 35, and the surface thereof is formed with a pedestal 37 for fixedly attaching a root portion of the liquid supply needle 35.

The supply needle unit 33 is disposed on the attachment surface of the case 16. In the disposition state, a liquid outlet and the connection protrusion of the case 16 communicate with each other via a packing 38 in a liquid-tight state. In addition, at the inside of the connection protrusion, a liquid supply path 39 passing through the case 16 is formed. The liquid supply path 39 communicates with the common liquid chamber 40 of the flow path unit 17. Thus, the liquid stored in the liquid cartridge 34 flows in the common liquid chamber 40 through the liquid supply path 39.

In the recording head 3 and the supply needle unit 33, there is formed a series of liquid flow paths that lead from the liquid supply needle 35 through the common liquid chamber 40 and the pressure chamber 24 to the nozzle 25. In addition, upon operating the piezoelectric vibrator 19, the volume of the pressure chamber can be changed as described above. By the fluctuation in the volume of the pressure chamber, the pressure fluctuation occurs in the liquid within the pressure chamber 24, and thus, the liquid pressure in the pressure chamber 24 can be changed, whereby the liquid droplets can be ejected from the nozzle 25. For example, when the piezoelectric vibrator 19 is charged to expand the pressure chamber 24 and then the piezoelectric vibrator 19 is rapidly discharged to contract the pressure chamber 24, the liquid flowed in the pressure chamber 24 is rapidly pressurized by the expansion of the pressure chamber 24 and the liquid droplets are ejected from the nozzle 25.

As the ink ejected from the printer 1, for example, a pigment ink is used. The ink is regulated so that a pigment concentration, a moisturizer concentration or the like is suitable for the application of the image printing or the like. In addition, in the present embodiment, total 6 colors of inks of black ink (K), cyan ink (C), magenta ink (M), yellow ink (Y), white ink (W), and silver ink (S) are used. As these inks, it is desirable to use an ultraviolet curable ink (a UV ink: a kind of photo curable liquid). The ultraviolet curable ink is different from a normal water-based ink in that, after landing the ink on the recording medium (an object to be landed), by irradiating the ultraviolet from an ultraviolet irradiation unit (not shown) with respect to the landing position to cure the ink, a stable printing quality can be secured without being influenced by the physical property of the recording medium such as the ink permeability.

Herein, the white ink is an ink that contains a white-based pigment, and is a kind of the white-based liquid in the invention. As the white-based pigment, for example, titanium dioxide can be suitably used. Furthermore, the silver ink is an ink including the gloss-based pigment and a kind of the gloss-based liquid in the invention. As the gloss-based pigment, for example, it is possible to use a powder-type or paste-type metal pigment formed of a metal such as aluminum, and a pearl pigment formed of mica titanium or the like in which the surface of mica is coated with the metal oxide. The printer 1 is configured so that a special visual effect can be obtained in the recording image using the white ink or the silver ink. This point will be described later.

Next, an allocation of each color of ink to the nozzle row will be described.

Figure 3:
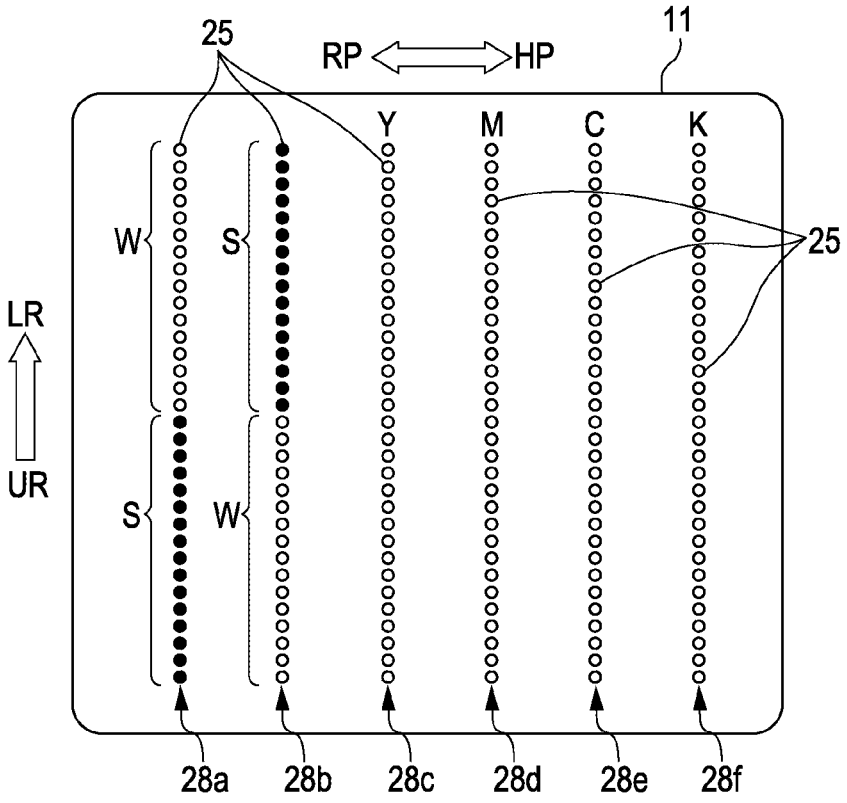
FIG. 3 is a schematic diagram that illustrates an arrangement of a nozzle row according to an aspect of the invention.

FIG. 3 is a top plan view that explains the configuration of the nozzle plate 11. In FIG. 3, a left and right direction is a main scanning direction, a right side thereof is a home position side (HP), and a left side thereof is a recording area side (RP). Furthermore, an up and down direction in FIG. 3 is a sub-scanning direction (a transportation direction of the recording paper 6), a lower side thereof is an upstream side (UR), and an upper side is a downstream side (LR). The nozzle plate 11 is a thin plate formed of the metal or the like in which a plurality of nozzles 25 is formed in a pitch corresponding to the dot formation density. In the nozzle plate 11 in the present embodiment, a plurality of nozzles 25 is provided in rows in a direction equivalent to the sub-scanning direction to constitute each nozzle row 28*a*-28*f*, whereby a plurality of nozzle rows 28*a*-28*f* is formed in a direction equivalent to the main scanning direction. In the present embodiment, six rows of nozzle rows 28*a*-28*f* are formed. Each nozzle row 28*a*-28*f* is formed of 360 nozzles 25 that are opened, for example, by the pitch corresponding to 360 dpi. In the present embodiment, a first nozzle row 28*a* corresponding to the white ink (W) and the silver ink (S), a second nozzle row 28*b* corresponding to the white ink (W) and the silver ink (S), a third nozzle row 28*c* corresponding to the yellow ink (Y), a fourth nozzle row 28*d* corresponding to the magenta ink (M), a fifth nozzle row 28*e* corresponding to the cyan ink (C), and a sixth nozzle row 28*f* corresponding to the black ink (K) are formed in rows in the direction corresponding to the main scanning direction.

Herein, there is a relative positional relationship in which, at the time of being on the forward pass of the recording head 3 in the main scanning direction, the first nozzle row 28*a* becomes the front side (from which ink is first ejected), and the second nozzle row 28*b* becomes the rear side. On the other hand, at the time of being on the returning pass thereof, the second nozzle row 28*b* becomes the front side and the first nozzle row 28*a* becomes the rear side. The first nozzle row 28*a* is divided into two nozzle groups including the nozzle group (shown by black circles in the drawing) of an upstream side half (180) in the sub-scanning direction and the nozzle group of a downstream side half (180) in the same direction, and the liquid flow paths of both nozzle groups are also separated from each other. In addition, it is configured so that the nozzle group disposed at the upstream side ejects the silver ink (S), and the nozzle group disposed at the downstream side ejects the white ink (W). Thus, the nozzle group of the upstream side of the first nozzle row 28*a* is equivalent to the gloss-based correspondence nozzle group and the downstream nozzle group thereof is equivalent to the white-based correspondence nozzle group. Similarly, the second nozzle row 28*b* is configured so that the nozzle group disposed at the upstream side thereof ejects the white ink (W) and the nozzle group (shown by black circles in the drawing) disposed at the downstream side thereof ejects the silver ink (S). The nozzle group of the upstream side of the second nozzle row 28*b* is equivalent to the white-based correspondence nozzle group, and the downstream side nozzle group thereof is equivalent to the gloss-based correspondence nozzle group. In addition, the first nozzle row 28*a* and the second nozzle row 28*b* are disposed in the state of being adjacent to each other without other nozzle row being disposed therebetween. Moreover, the first nozzle row 28*a* and the second nozzle row 28*b* are disposed relatively in the same position in the main scanning direction. For example, it is not preferable to adopt an arrangement in which the second nozzle row 28*b* deviates with respect to the nozzle pitch of the first nozzle row 28*a* by the half pitch. This arrangement is caused by the fact that after ejecting the silver ink, the white ink is ejected to and landed on the landing position of the silver ink in the present embodiment. The details thereof will be described later.

Figure 4:
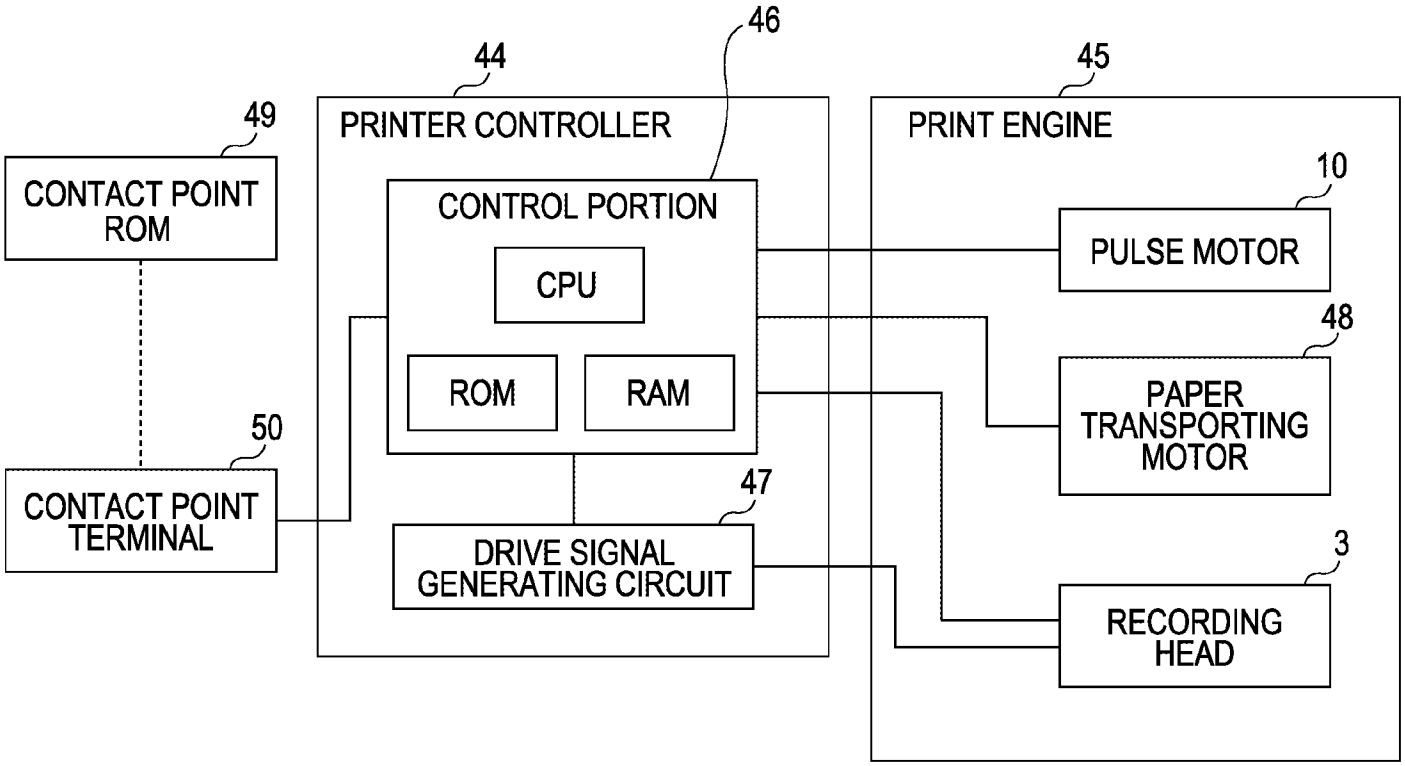
FIG. 4 is a block diagram that illustrates an electric configuration of a printer according to an aspect of the invention.

Next, the electric configuration of the printer 1 will be described. As shown in FIG. 4, the printer 1 is roughly constituted by a print controller 44 and a print engine 45.

The print controller 44 includes a control portion 46 (a kind of control unit) including a CPU, a ROM and a RAM, a drive signal generating circuit 47 (a kind of drive signal generating unit) that generates the drive signal for supplying to the recording head 3 or the like. On the other hand, the print engine 45 includes a pulse motor 10 (a kind of relative movement unit), a paper transporting motor 48 (a kind of landing object transporting unit), and the recording head 3 or the like. In addition, the operations of the respective portions can be controlled by the control portion 46.

The control portion 46 is a portion that performs the control in the printer 1. The control portion 46 is electrically connected to a contact point terminal 50, and thus it is possible to read various pieces of information stored in a contact point ROM 49 of the mounted liquid cartridge 34. For this reason, the control portion 46 can recognize the type or the like of ink stored in the liquid cartridge 34 based on the read information. Furthermore, the control portion 46 can redraft various pieces of information stored in the contact point ROM 49.

The control portion 46 creates the dot pattern data for controlling the recording head 3 based on the print data that is transmitted from an external apparatus such as a host computer. In addition, the control portion 46 transmits the created dot pattern data to the recording head 3. Furthermore, the control portion 46 also serves as a drive signal setting unit, sets the drive signal of the waveform suitable for the printing the image or the like, and generates the drive signal from the drive signal generating circuit 47. In addition, the control portion 46 operates the pulse motor 10 to move the carriage 4 (the recording head 3) to a desired position or operates the paper transporting motor 48 to deliver the recording paper 6.

Figure 5:
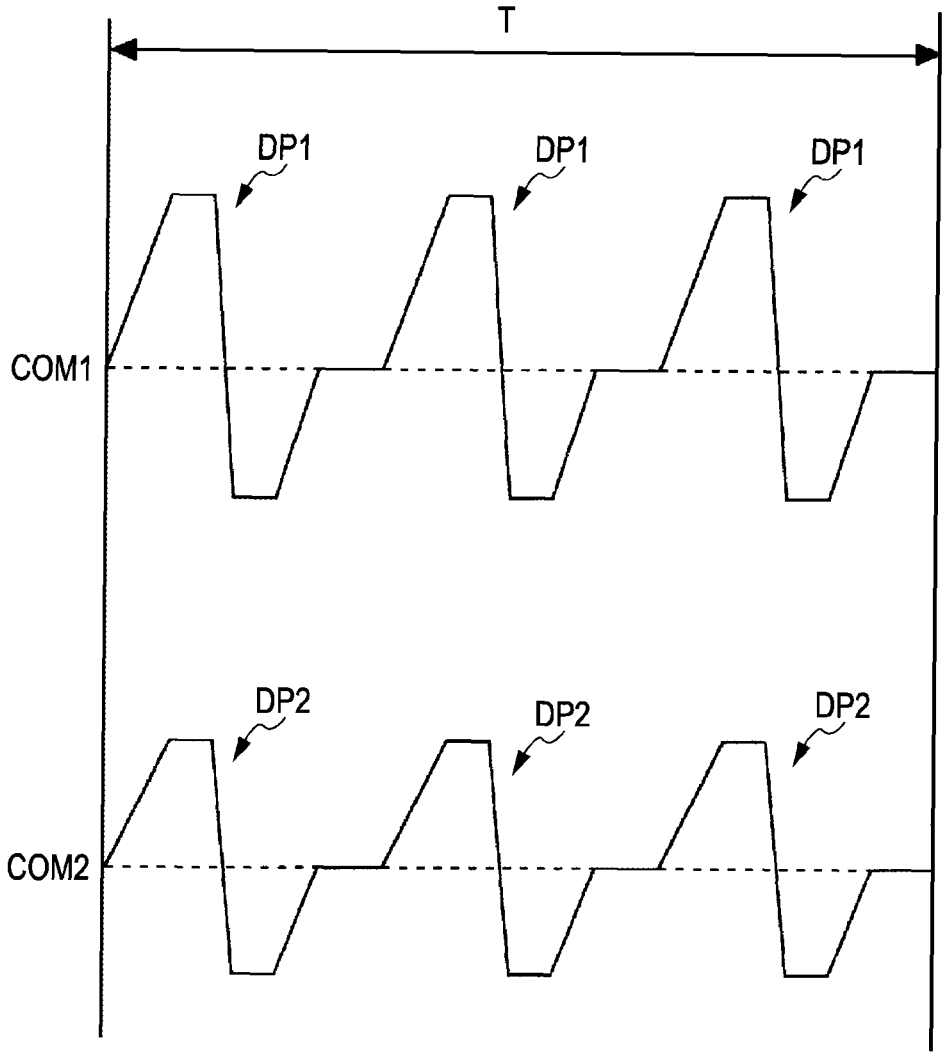
FIG. 5 is a diagram that illustrates a drive signal generated from a drive signal generating circuit according to an aspect of the invention.

The drive signal generating circuit 47 is a portion that serves as the drive signal generating unit, and generates the drive signal for supplying to the recording head 3 under the control by the control portion 46. As shown in FIG. 5, the drive signal generating circuit 47 of the present embodiment can concurrently generate two types of drive signals COM1 and COM2.

Hereinafter, each drive signal will be described. The first drive signal COM1 is a series of signals that include three first drive pulses DP1, which are set so as to enlarge the ejection amount of the liquid droplet as much as possible, within a unit period that is a repeating period of the drive signal and is divided into a timing signal such as a latch pulse at equal distances. The first drive pulse DP1 is a drive pulse which sets the drive voltage, that is, the electric potential difference between a maximum electric potential and a minimum electric potential as high as possible up to an extent that is allowable by the piezoelectric vibrator 19. In addition, whenever the first drive pulse DP1 is supplied to one piezoelectric vibrator 19, the maximum amount of ink droplets is ejected from the nozzle 25. In the present embodiment, when the silver ink is mainly ejected, the first drive pulse DP1 is used.

As shown in FIG. 5, the second drive signal COM2 is a series of signals that includes three second drive pulses DP2 within the unit period at equal distances. The second drive pulse DP2 is a drive pulse which is set so that the amount of the ejected ink droplet becomes smaller than the case of the first drive pulse DP1, while the basic waveform shape thereof is the same as that of the first drive pulse DP1. More particularly, the second drive pulse DP2 is different from the first drive pulse DP1 in that the drive voltage is set to be lower than that of the first drive pulse DP1. In the present embodiment, in a case where ejecting the ink other than the silver ink, the second drive pulse DP2 is used. In addition, the first drive pulse DP1 and the second drive pulse DP2 are configured so that the drive voltages thereof are different from each other, but the present invention is not limited thereto. For example, by making the drive voltages of both equal to each other and making the slope of the electric potential change of the second drive pulse DP2 gentler than that of the first drive pulse DP1, the amount of the ink droplets ejected by the second drive pulse DP2 may be smaller than the case of the first drive pulse DP1.

Next, in the printer 1 having the configuration as mentioned above, the printing process using the silver ink and the white ink will be described. In this printing process, the silver ink is ejected onto the recording medium such as the recording paper 6 in advance to print the recording medium using the silver ink layer (forming the glossy layer of the invention) as a base, and then, the white ink is ejected onto the silver ink layer to form the white ink layer in an overlapping manner (forming the white layer of the invention).

When the power supply is turned on, the control portion 46 carries out a predetermined initializing operation. In the initializing operation, the carriage 4 is operated in the main scanning direction, thereby performing the position recognition of the carriage 4 (the recording head 3) or the like, or clearing unnecessary information within the work area. If the initializing operation has been performed, the control portion 46 controls the pulse motor 10 or the paper transporting motor 48, thereby moving the carriage 4 in the main scanning direction (equivalent to the relative movement direction in the invention) and delivering the recording paper 6 in the sub-scanning direction (equivalent to the transportation direction in the invention). In addition, the control portion 46 controls the supply of the first drive pulse DP1 and the second drive pulse DP2 to the piezoelectric vibrator 19 in synchronization with the movement of the carriage 4 or the recording paper 6.

Figure 6A:
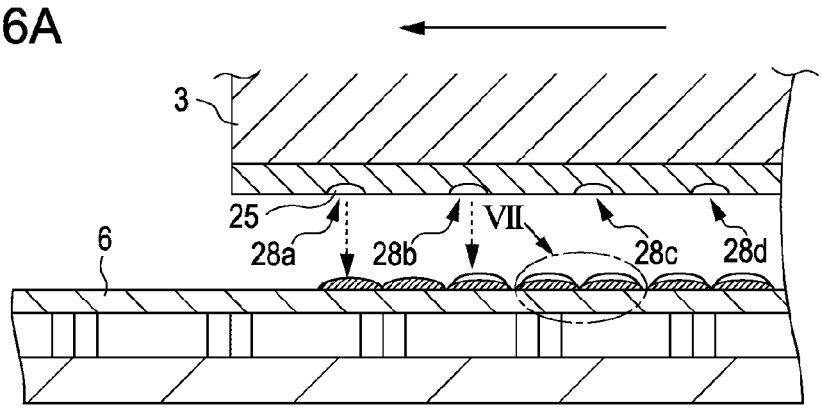
FIG. 6A is a schematic diagram that illustrates a form of printing process at the time of a forward pass.

FIG. 6A is a schematic diagram that explains the aspect of the printing process (the recording process) in the forward pass direction (equivalent to a first relative movement direction) in which the recording head 3 performs the ejection of ink from the nozzle 25 while moving from one home position side in the main scanning direction to the other side thereof. Furthermore, FIG. 7 is an enlarged view of an area VII in FIGS. 6A and 6B. As shown in FIG. 6A, in the forward pass, the silver ink is ejected from the gloss-based correspondence nozzle group (S) disposed at the upstream side of the first nozzle row 28*a* in the sub-scanning direction by the first ejection pulse DP1 and is landed in a predetermined position of the recording paper 6. As a result, the silver ink layer 51 is formed on the recording paper 6. Then, at the timing when the recording head 3 is moved by the gap of the adjacent nozzle rows, the white ink is ejected from the white-based correspondence nozzle group disposed at the upstream side of the second nozzle row 28*b* in the sub-scanning direction by the second drive pulse DP2 and is landed on the silver ink layer 51 that was formed in advance. As a result, as shown in FIG. 7, the white ink layer 52 is formed on the silver ink layer 51 in an overlapped manner. In this manner, the printing process of the forward pass is performed while alternately ejecting the silver ink and the white ink from the recording head 3 in an overlapped manner.

Figure 6B:
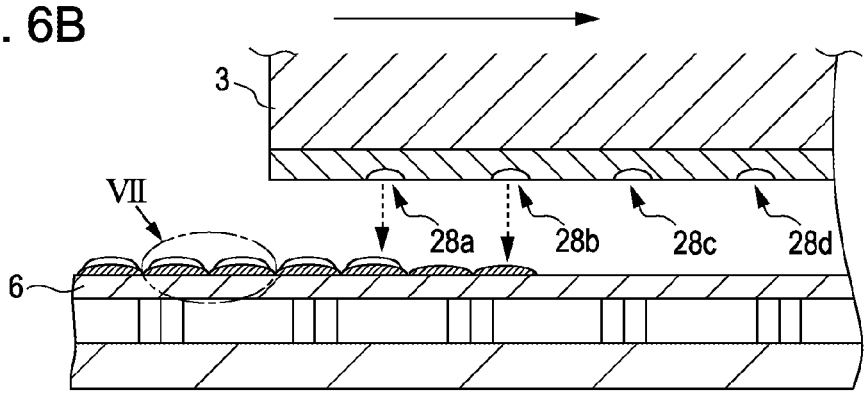
FIG. 6B is a schematic diagram that explains a form of printing process at the time of a returning pass.
Figure 7:
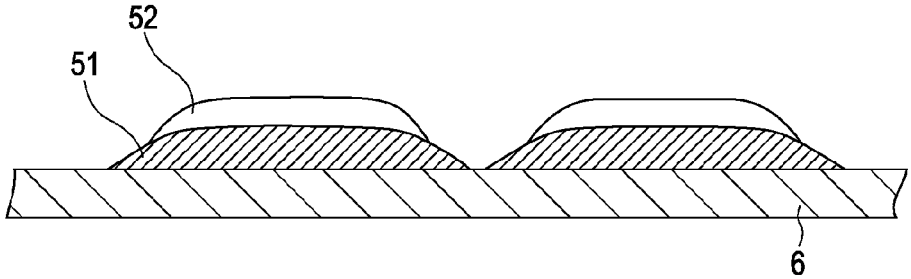
FIG. 7 is an enlarged view of an area VII in FIGS. 6A and 6B.

FIG. 6B is a schematic diagram that explains the aspect of the printing process in the returning pass direction (equivalent to a second relative movement direction) in which the recording head 3 performs the ejection of ink from the nozzle 25 while moving from the other side in the main scanning direction to one home position side thereof. When the printing process of the forward pass is finished, the recording paper 6 is transported to the downstream side of the sub-scanning direction by the half of the nozzle row, that is, the distance corresponding to the length of one nozzle group through the operation of the paper transporting motor 48, and then the printing process of the returning pass is performed. As shown in FIG. 6B, in the returning pass, the silver ink is ejected from the gloss-based correspondence nozzle group (S) disposed at the downstream side of the second nozzle row 28*b* in the sub-scanning direction by the first drive pulse DP1, and is landed in a predetermined position of the recording paper 6, whereby the silver ink layer 51 is formed. Then, at the timing when the recording head 3 is moved by the gap of the adjacent nozzle rows, the white ink is ejected from the white-based correspondence nozzle group disposed at the downstream side of the first nozzle row 28*a* in the sub-scanning direction by the second drive pulse DP2 and is landed on the silver ink layer 51 that was formed in advance. As a result, in the same manner as the case of the forward pass, the white ink layer 52 is formed on the silver ink layer 51 in an overlapped manner.

In this manner, the printing process of the returning pass is performed while alternately ejecting the silver ink and the white ink in an overlapped manner.

In this manner, by performing the printing process while alternately ejecting the silver ink and the white ink in the forward pass and the returning pass, the ground color of the recording medium such as the recording paper 6 is covered over the silver ink layer 51 and is concealed and the white ink layer 52 is formed thereon using the silver ink layer 51 as a base, and thus, the glossy feeling of the silver ink layer 51 can be obtained. As a result, as compared to a case of directly forming the white ink layer 52 on the recording medium, the brightness of the white ink layer 52 can be heightened, with the result that the white coloring can be further accentuated.

In addition, in the present embodiment, the amount of the ink droplets when the silver ink is ejected is set to become larger than that when the white ink is ejected, and thus, the area covered by the silver ink layer 51 becomes greater than that of the white ink layer 52. As a result, the ground color of the recording medium of the silver ink layer 51 is more reliably concealed and the glossy feeling is further emphasized, and thus, the coloring of the white ink layer 52 can be further accentuated. In addition, even if, particularly, the recording medium is a resin film or the like through which light is transmitted, by the concealment action of the silver ink layer 51 being the base, the coloring property of ink to be formed thereon can be secured. In addition, in the printer 1, it is possible to effectively perform the recording both in the forward pass and the returning pass.

Herein, in the above-mentioned embodiment (the first embodiment), the configuration, in which white is accentuated by forming the white ink layer 52 thereon using the silver ink layer 51 as the base, has been described, but the invention is not limited thereto, on the contrary, the metallic texture can be accentuated by forming the silver ink layer thereon using the white ink layer as the base.

Figure 8:
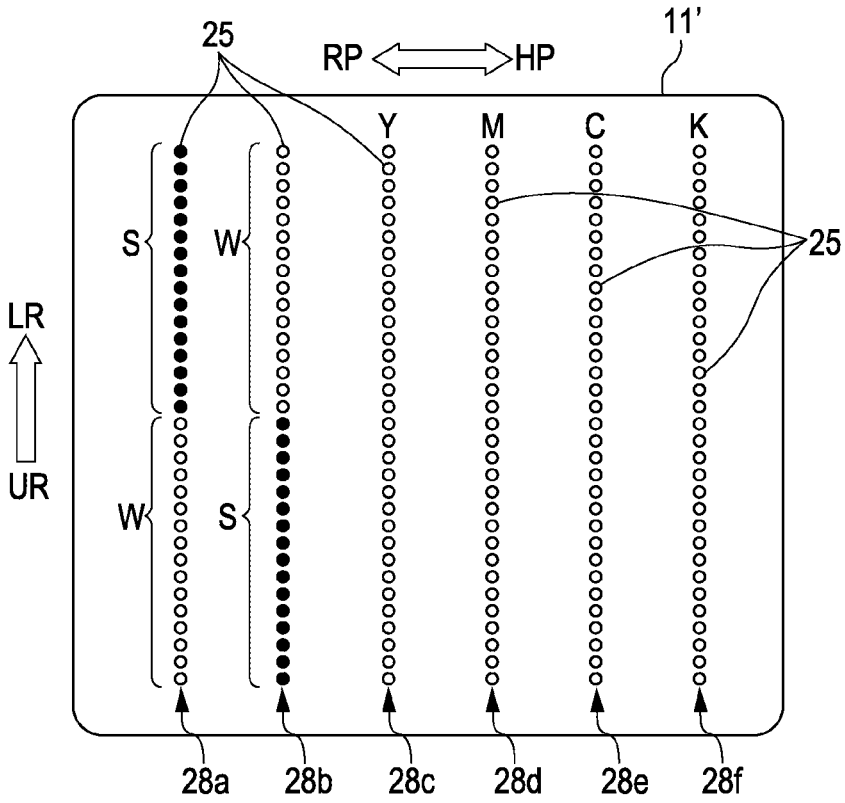
FIG. 8 is a schematic diagram that illustrates an arrangement of a nozzle row in a second embodiment according to the invention.

FIG. 8 is a top plan view that explains a configuration of a nozzle plate 11' in a second embodiment. The difference from the first embodiment is the allocation of the silver ink and the white ink in the first nozzle row 28*a* and the second nozzle row 28*b*, and other configurations are the same as those of the first embodiment, and thus the description thereof will be omitted. The first nozzle row 28*a* in the present embodiment is configured so that the nozzle group of the upstream side half of the sub-scanning direction ejects the white ink (W) and the nozzle group disposed at the downstream side ejects the silver ink (S). Thus, the nozzle group of the upstream side of the first nozzle row 28*a* is equivalent to the white-based correspondence nozzle group, and the nozzle group of the downstream side thereof is equivalent to the gloss-based correspondence nozzle group. Similarly, the second nozzle row 28*b* is configured so that the nozzle group disposed at the upstream side thereof ejects the silver ink (S) and the nozzle group disposed at the downstream side thereof ejects the white ink (W). Thus, the nozzle group of the upstream side of the second nozzle row 28*b* is equivalent to the gloss-based correspondence nozzle group, and the nozzle group of the downstream side is equivalent to the white-based correspondence nozzle group. In addition, the first nozzle row 28*a* and the second nozzle row 28*b* are in the adjacent state without other nozzle rows disposed therebetween.

Next, the printing process using the silver ink and the white ink in the present embodiment will be described. In the printing process, after the white ink is ejected onto the recording medium such as the recording paper 6 in advance to perform the printing using the white ink layer as the base, the silver ink is ejected onto the white ink layer to form the silver ink layer in an overlapping manner.

Figure 9A:
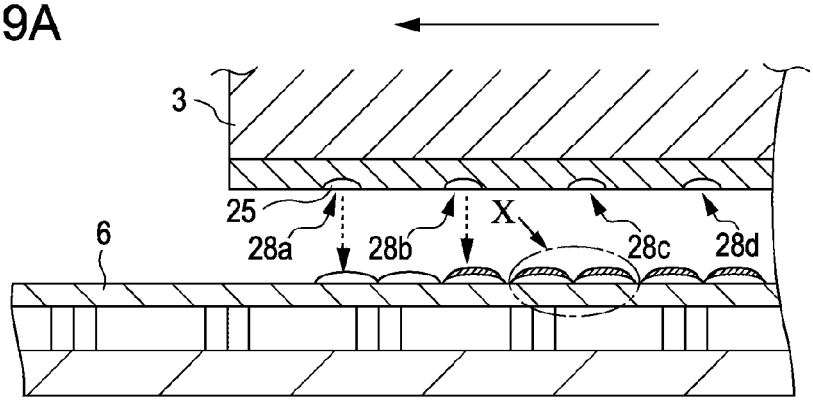
FIG. 9A is a schematic diagram that illustrates a form of printing process of a forward pass direction in a second embodiment according to the invention.

FIG. 9A is a schematic diagram explaining the aspect of the printing process in the forward pass direction in the present embodiment. Furthermore, FIG. 10 is an enlarged view of an area X in FIGS. 9A and 9B. As shown in FIG. 9A, in the forward pass, the white ink is ejected from the white-based correspondence nozzle group (W) disposed at the upstream side of the first nozzle row 28*a* in the sub-scanning direction by the first ejection pulse DP1 and is landed in a predetermined position of the recording paper 6. As a result, the white ink layer 52 is first formed on the recording paper 6. Then, at the timing when the recording head 3 is moved by the gap of the adjacent nozzle rows, the silver ink is ejected from the gloss-based correspondence nozzle group disposed at the upstream side of the second nozzle row 28*b* in the sub-scanning direction by the second drive pulse DP2 and lands on the white ink layer 52 that was formed in advance. As a result, as shown in FIG. 10, the silver ink layer 51 is formed on the white ink layer 52 in an overlapping manner. In this manner, the printing process of the forward pass is performed while alternately ejecting the white ink and the silver ink from the recording head 3 in an overlapping manner.

Figure 9B:
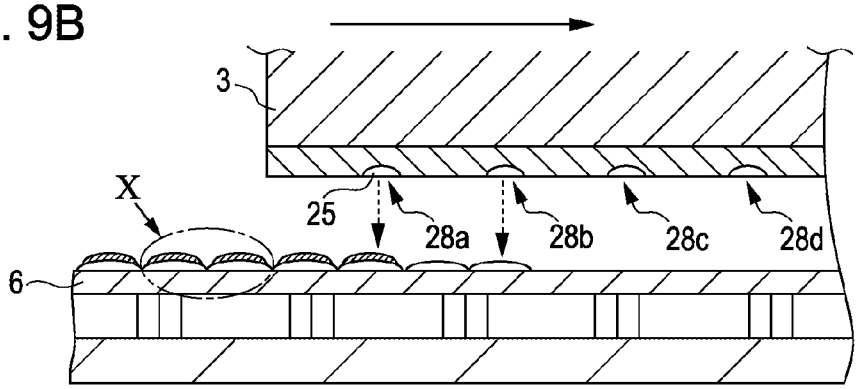
FIG. 9B is a schematic diagram that illustrates a form of printing process of a returning pass direction in the present embodiment.
Figure 10:
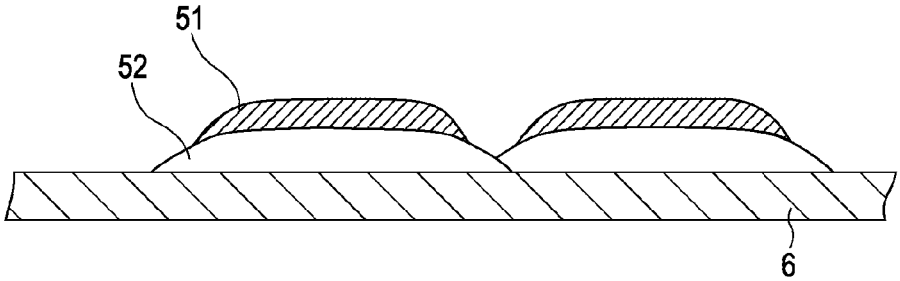
FIG. 10 is an enlarged view of an area X in FIGS. 9A and 9B according to another aspect of the invention.

FIG. 9B is a schematic diagram that explains the aspect of the printing process of the returning pass direction in the present embodiment. When the printing process of the forward pass is finished, the recording paper 6 is transported to the downstream side of the sub-scanning direction by half of the nozzle row, that is, the distance corresponding to the length of one nozzle group through the operation of the paper transporting motor 48, and then the printing process of the returning pass is performed. As shown in FIG. 9B, in the returning pass, the white ink is ejected from the white-based correspondence nozzle group (W) disposed at the downstream side of the second nozzle row 28*b* in the sub-scanning direction by the first drive pulse DP1, and is landed in a predetermined position of the recording paper 6, whereby the white ink layer 52 is formed. Then, at the timing when the recording head 3 is moved by the gap of the adjacent nozzle rows, the silver ink is ejected from the gloss-based correspondence nozzle group disposed at the downstream side of the first nozzle row 28*a* in the sub-scanning direction by the second drive pulse DP2 and is landed on the white ink layer 52 that was formed in advance.

As a result, in the same manner as the case of the forward pass, the silver ink layer 51 is formed on the white ink layer 52 in an overlapping manner. In this manner, the printing process of the returning pass is performed while alternately ejecting the white ink and the silver ink in an overlapping manner.

In this manner, by performing the printing process while alternately ejecting the white ink and the silver ink in both directions of the forward pass and the returning pass, the ground color of the recording medium such as the recording paper 6 is covered by the white ink layer 52 and is concealed and the silver ink layer 51 is formed thereon using the white ink layer 52 as the base. Thus, as compared to a case of directly forming the silver ink layer 51 on the landing object, the brightness of the silver ink layer 51 can be heightened, with the result that the metallic glossy feeling of silver ink layer 51 can be further accentuated.

In addition, in the present embodiment, the first drive pulse DP1 and the second drive pulse DP2 can be used separately so that the amount of the ink droplets when the white ink is ejected is set to become larger than that when the silver ink is ejected. Thus, the covering area of the white ink layer 52 becomes greater than that of the silver ink layer 51. As a result, the ground color of the recording medium can be more reliably concealed by the white ink layer 52 and the glossy feeling is further emphasized, and thus, the glossy feeling of the silver ink layer 51 can be further accentuated. In addition, particularly, even if the recording medium is a resin film or the like through which light is transmitted, by the concealment action of the white ink layer 52 which is the base, the coloring property of ink to be formed thereon can be secured.

The present invention is not limited to the above-mentioned embodiment but can be variously modified based on description of the claims.

In each embodiment, the description has been given of the configuration in which the recording head 3 (the carriage 4 with the same mounted thereon) is relatively moved with respect to the recording medium of the stationary state in the reciprocating printing process in the main scanning direction, but the invention is not limited thereto. For example, it is also possible to adopt a configuration in which the recording medium is relatively moved with respect to the recording head 3 in the state in which the position of the recording head 3 is fixed.

Moreover, in the above-mentioned embodiment, the invention was described using one recording head 3, which includes for example, the first nozzle row 28*a* corresponding to the white ink (W) and the silver ink (S), the second nozzle row 28*b* corresponding to the white ink (W) and the silver ink (S), the third nozzle row 28*c* corresponding to the yellow ink (Y), the fourth nozzle row 28*d* corresponding to the magenta ink (M), the fifth nozzle row 28*e* corresponding to the cyan ink (C), and the sixth nozzle row 28*f* corresponding to the black ink (K) are formed so as to be arranged in the direction corresponding to the main scanning direction.

However variations may be made wherein, for example, the recording head in which the first nozzle row 28*a* corresponding to the white ink (W) and the silver ink (S), and the second nozzle row 28*b* corresponding to the white ink (W) and the silver ink (S) are provided and the recording head with the nozzle rows of other colors provided therein may be individually provided without being limited to this form. In addition, the recording head with the first nozzle row 28*a* corresponding to the white ink (W) and the silver ink (S) provided therein and the recording head with the second nozzle row 28*b* corresponding to the white ink (W) and the silver ink (S) provided therein may be separated from each other, and the "recording head" and the "liquid ejection head" of the invention are interpreted as collectively expressing that a plurality of recording heads (the liquid ejection heads) is provided.

Furthermore, the drive signal for driving the piezoelectric vibrator 19 and the drive pulse included therein are not limited to those indicated in the above-mentioned embodiment, but can adopt an arbitrary configuration. In short, a configuration, in which the amount of ink forming the base becomes larger than the amount of the ink to be landed on the base, may be adopted.

Moreover, in the above-mentioned embodiment, the first nozzle row 28*a* and the second nozzle row 28*b* were provided by dividing the white ink nozzles and the silver ink nozzles equally respectively. However, for example, depending on the printing data, the white ink nozzles of the first nozzle row 28*a* may be provided in a greater number than the silver ink nozzles, and the white ink nozzles of the second nozzle row 28*b* may be provided so as to relatively reduce the silver ink nozzles of the second nozzle row 28*b* in view of the number of the silver ink nozzles of the first nozzle row 28*a*, without being limited to that indicated in the above-mentioned embodiment.

In addition, the example described above is an ink jet type recording printer. However, the invention is not limited thereto. The invention can be applied to other liquid ejection apparatuses, for example, a color material ejection apparatus used in manufacturing a color filter of a liquid crystal display or the like, an electrode material ejection apparatus used in forming the electrode of an organic EL display, a FED or the like, and a vital organic matter ejection apparatus or the like used in manufacturing a bio chip, if they have a configuration which lands two kinds of liquids on the landing object in an overlapping manner.

What is claimed is:

1. A liquid ejecting method comprising:

ejecting a white-based liquid from a liquid ejecting head which ejects liquid from nozzles of a nozzle row, to a predetermined position of an ejection target, thereby forming a white layer at the predetermined position; and ejecting a gloss-based liquid onto the white layer, thereby forming a glossy layer on the white layer, wherein an ejection amount of the white-based liquid ejected when forming the white layer is greater than of the amount of the gloss-based liquid ejected when forming the glossy layer on the white layer.

2. A liquid ejecting apparatus comprising:

a liquid ejection head that ejects liquid from nozzles of a nozzle row;

a first nozzle row that has a white-based correspondence nozzle group for ejecting a white-based liquid and a gloss-based correspondence nozzle group for ejecting a gloss-based liquid, the first nozzle row being disposed at a front side in a first relative movement direction relative to a landing object in the liquid ejection head; and a second nozzle row that has a white-based correspondence nozzle group and a gloss-based correspondence nozzle group, the second nozzle row being disposed at a rear side in the first relative movement direction in the liquid ejection head, wherein, in the movement in the first relative movement direction, after the white-based liquid is ejected from the white-based correspondence nozzle group of the first nozzle row, the gloss-based liquid is ejected from the gloss-based correspondence nozzle group of the second nozzle row, and wherein, in the movement of a second relative movement direction opposite to the first relative movement direction, after the white-based liquid is ejected from the white-based correspondence nozzle group of the second nozzle row, the gloss-based liquid is ejected from the gloss-based correspondence nozzle group of the first nozzle row.

3. The liquid ejecting apparatus according to claim 2, wherein the amount of the liquid droplets of the white-based liquid ejected from the nozzles is greater than the amount of the liquid droplets of the gloss-based liquid ejected from the nozzles.

4. The liquid ejecting apparatus according to claim 2, wherein, in the first nozzle row, the white-based correspondence nozzle group is disposed at an upstream side in a transport direction when the landing object is transported in a direction intersecting the relative movement direction while the gloss-based correspondence nozzle group is disposed at a downstream side in the same direction, and wherein, in the second nozzle row, the gloss-based correspondence nozzle group is disposed at the upstream side in the transport direction of the landing object while the white-based correspondence nozzle group is disposed at the downstream side in the same direction.

5. The liquid ejecting apparatus according to claim 2, wherein the first nozzle row and the second nozzle row are adjacent to each other without other nozzle rows disposed there between.

* * * * *